United States Patent [19]

Elmgren

[11] 4,003,697

[45] Jan. 18, 1977

[54] PRESSURE FURNACE FOR TREATING PRODUCTS AT HIGH TEMPERATURE AND HIGH PRESSURE

[75] Inventor: Staffan Elmgren, Helsingborg, Sweden

[73] Assignee: Allmanna Svenska Elektriska Aktiebolaget, Vasteras, Sweden

[22] Filed: July 3, 1975

[21] Appl. No.: 593,048

[30] Foreign Application Priority Data

July 30, 1974 Sweden ..... 7409804

[52] U.S. Cl. ..... 432/238; 432/241; 425/77; 13/31; 13/32; 266/253

[51] Int. Cl.[2] ..... F27B 5/04; F27D 1/12

[58] Field of Search ..... 432/205, 206, 238, 241, 432/81, 123; 13/31, 32, 33; 214/23; 266/5 A, 4 B, 27, 28, 253; 425/77, 78

[56] References Cited

UNITED STATES PATENTS

| | | | |
|---|---|---|---|
| 2,269,595 | 1/1942 | Miller | 266/5 A |
| 2,869,856 | 1/1959 | Greene | 432/241 |
| 3,020,032 | 2/1962 | Casey | 432/205 |
| 3,732,068 | 5/1973 | Larker | 432/205 |
| 3,775,043 | 11/1973 | Johansson et al. | 432/205 |
| 3,836,325 | 9/1974 | Nakamura et al. | 432/123 |
| 3,940,245 | 2/1976 | Smith, Jr. et al. | 432/242 |

*Primary Examiner*—John J. Camby
*Assistant Examiner*—Henry C. Yuen
*Attorney, Agent, or Firm*—Watson, Cole, Grindle & Watson

[57] ABSTRACT

A pressure furnace for treating products at high temperature and high pressure includes a high pressure chamber formed of a vertical high pressure cylinder with end closures projecting into the cylinder and a press stand with a window aperture which is somewhat larger than the height of the high pressure chamber when the end closures are fully inserted for enclosing the high pressure chamber during the pressing operation. A support member is provided which holds the pressure chamber in such a position that gaps are formed between the press stand and the end closures when the latter are moved into their innermost positions in the chamber. The lower end closure is at least in part removable and includes a bottom portion provided with cooling channels, with a stationary and a movable connection unit for connecting the bottom portion to a coolant source. The movable unit is displaceable between a connected position in contact with the stationary connection unit and a release position. Valve members are arranged in the connection unit, which, in released position, close the passage through the connection unit, but are opened when the movable connecting unit is moved towards the stationary connecting unit. The movable connecting unit also holds in position a disc-like central portion of the bottom closure which fits within an annular outer portion.

5 Claims, 3 Drawing Figures

PRESSURE FURNACE FOR TREATING PRODUCTS AT HIGH TEMPERATURE AND HIGH PRESSURE

BACKGROUND OF THE INVENTION

1. Field of the Invention

The present invention relates to a pressure furnace for treating products at high temperature and high pressure. It contains a furnace chamber which is enclosed in a pressure chamber and insulated from the walls of the pressure chamber by an insulating casing. The pressure chamber is built up of a high pressure cylinder and end closures projecting into this cylinder and is surrounded during the pressing by a press stand which takes up axial, outwardly-directed forces acting on the end closures. The pressure furnace is of the type which is charged from below with the aid of a manipulator which is intended to transport a furnace bottom with a charge resting thereon from a preheat furnace and to move the bottom and the charge into the furnace. A pressure furnace charged from below, which is substantially different from the pressure furnace according to the invention only with regard to the charging mechanism and certain constructional parts, is described in detail in U.S. Pat. No. 3,695,597.

Despite the good insulation between the furnace chamber and the pressure chamber walls, the heat losses in furnaces with large dimensions are so great that it is necessary to cool the pressure chamber walls so that their temperature is maintained below an acceptable level with regard to the resistance of the materials of which they are formed. Often it is particularly important that the area around seals between a pressure chamber cylinder and end closures and the area in the end closures should be cooled so that the material in the seals is not destroyed by too high a temperature. Particularly in furnaces which are charged from below, having a furnace bottom which carries the charge during the heating in a preheat furnace and which is transferred to the pressure chamber of the pressure furnace together with the heated charge, it has been found to be difficult to supply coolant to the furnace bottom. The connection between the furnace bottom and the source of the coolant must be easily disconnectible in such a way that there is no risk of losing an appreciable amount of coolant which may cause damage to the furnace.

SUMMARY TO THE INVENTION

According to the invention, the lower end closure of the pressure furnace contains a bottom portion provided with cooling channels, said bottom portion being intended to carry a charge of material to be treated during charging and pressing, and further a stationary and a disengageable connecting unit for connection of the divided bottom portion to a coolant source. The disengageable connection unit is arranged to be radially movable between a disengaged position and an engaged position in contact with the stationary connection unit. In the connection units there is a valve member which, in the disengaged position, is held sealingly pressed against a valve seat and, in the engaged position, is lifted from the valve seat by means of a valve member so that coolant can pass freely.

The bottom portion is formed of an outer annular section and an inner disc-like section which is intended to carry the object to be pressed for loading through the bottom of the furnace and is removable from within the annular section. The arrangement is such that the movable connecting unit when in the engaged position extends into a recess in the disc-like member and holds it in position.

BRIEF DESCRIPTION OF THE DRAWINGS

The invention is described in more detail with reference to the accompanying drawings.

DESCRIPTION OF THE PREFERRED EMBODIMENTS

Figure 1:
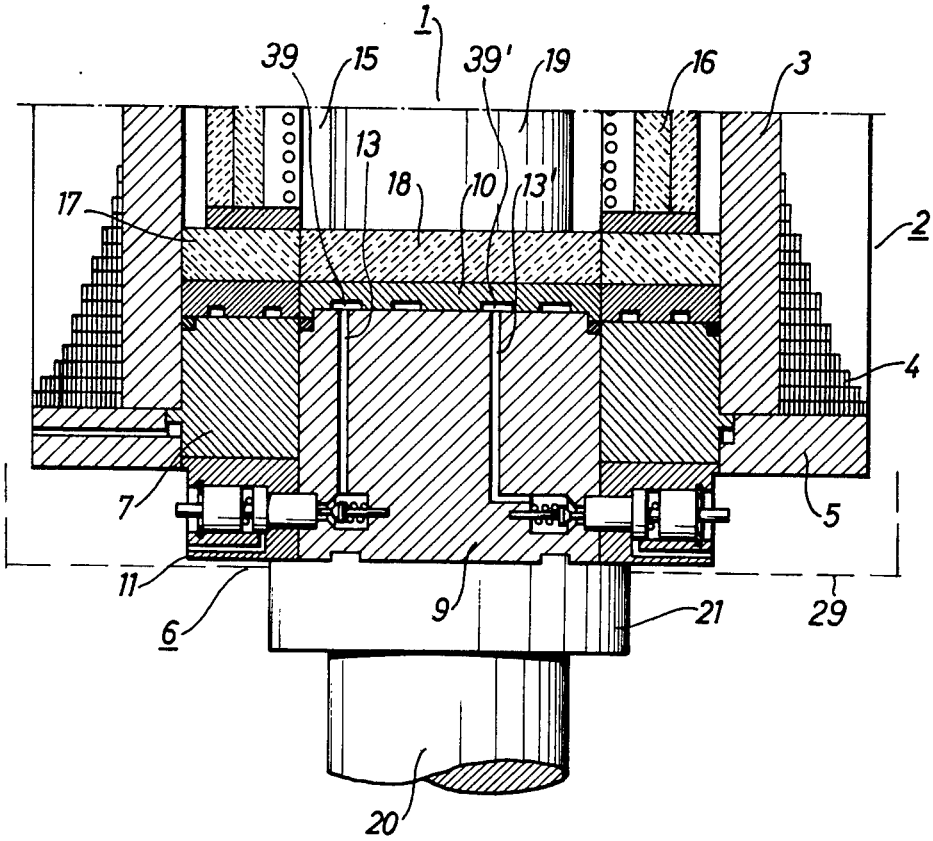
FIG. 1 shows a section through the lower part of a pressure chamber and the charge-carrying portion of a manipulator for charging the furnace.

In the drawings, 1 designates a pressure chamber containing a high pressure cylinder 2, which consists of an inner tube 3, a prestressed strip sheath 4 and an end ring 5. A lower end closure 6 projects somewhat into the tube of the high pressure cylinder 2. This end closure contains an annular bottom portion 7 with a cooling plate 8 and a cylindrical bottom portion 9 with a cooling plate 10. A ring 11 is joined to the ring 7. In this ring 11 there is a radially movable plunger unit 12, which at the same time can lock the bottom portion 9 in relation to the bottom portion 11 and connect cooling channels 13, 13' with a coolant source (not shown). In the pressure chamber 1 is a furnace chamber 15 which is surrounded by a sheath 16 with a heating element and an insulating layer. On the cooling plates 8 and 10 there are insulating layers 17 and 18. In the pressure chamber there is a charge 19 of material to be treated. The bottom portion 9 with the charge 19 is transported to and inserted in the pressure chamber 1 by means of a manipulator, of which only the upper parts of a lifting piston 20 and a support plate 21 are shown.

Figure 2:
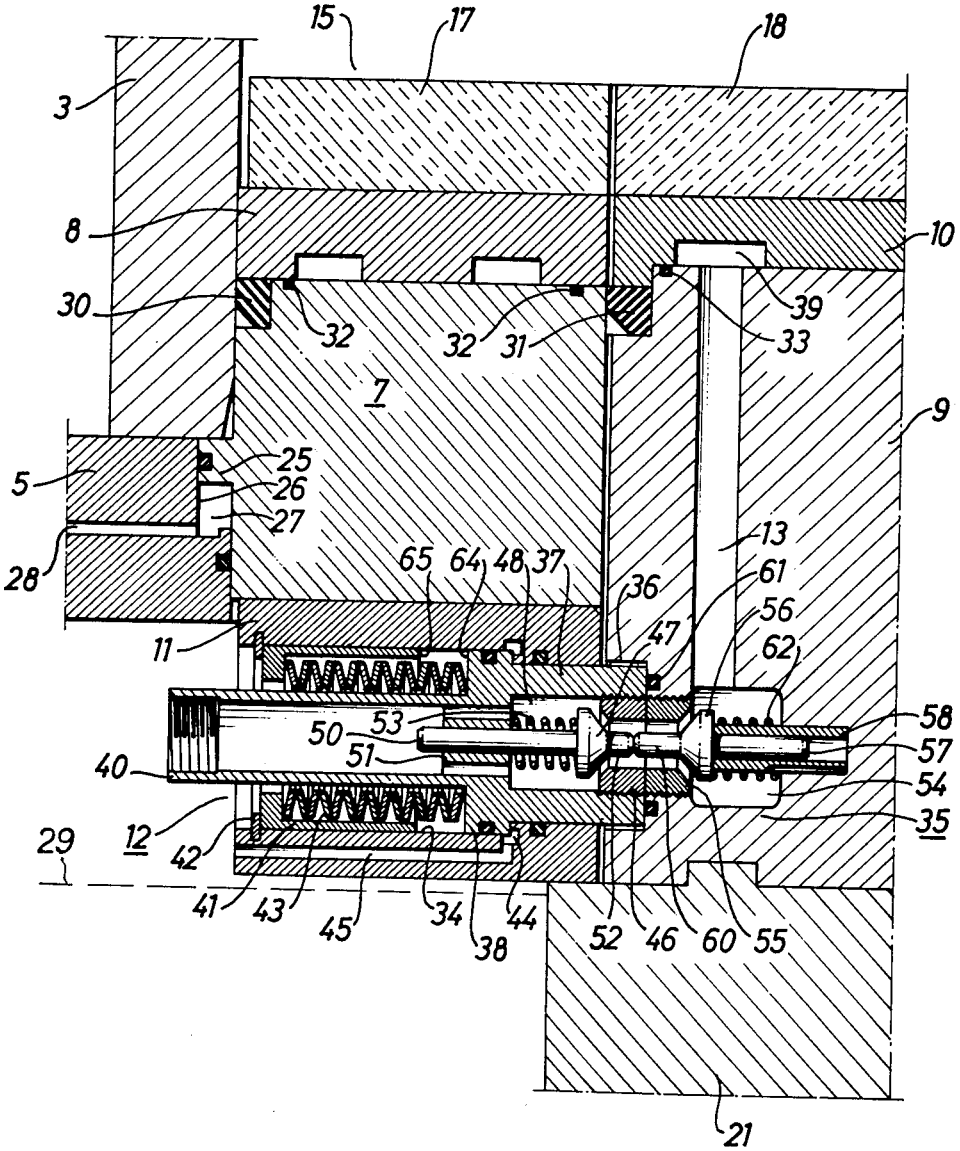
FIG. 2 shows on an enlarged scale connection units for cooling water.

FIG. 2 shows the parts on a larger scale. The annular bottom portion 7 is provided with a flange 25 and the ring 5 with an annular cavity 26 so that the portion 7 forms an annular piston running in a cylinder formed of the ring 5. After a pressing operation, the bottom portion is lifted to the position shown in the figure by supplying pressure medium to the cylinder space 27 through the channel 28, the bottom portion thus being released from the support surface in the press stand (diametrically indicated at 29) so that the stand can be easily removed. In the bottom portions 7 and 9 there are seals 30 and 31 for preventing the pressure medium from flowing out of the pressure chamber 1, and seals 32 and 33 sealing between the cooling plates 8 and 10, respectively, and the bottom portions.

In the ring 11 there are a number of recesses 34 in which the plunger units 12 are arranged. This simultaneously acts as a connection unit which connects with cooling water channels 13,13' and 39,39' in the bottom portion 9 and the cooling plate 10, respectively. The plunger unit 12 cooperates with a connection unit 35 at the bottom of the recess 36. The plunger unit 12 comprises a plunger 37 with a flange 38, which together form an annular piston, and a connection tube 40 which is connected to a pressure medium source (not shown). Further there are a sleeve 41, which is fixed in the recess 34 by a locking ring 42, and a bundle of springs 43 which tend to keep the plunger in the locking position shown in FIG. 2. The plunger can be moved to the left to a released position by supplying pressure medium to the space 44 through the channel 45. In the plunger there is arranged a connection unit for transferring coolant to the bottom portion. This contains a valve seat 46 and a valve cone 47 in the recess 48 in the plunger 37. The valve cone is joined to a guide pin 50, running in the guide 51, and a lift pin 52. The valve cone 47 is urged in the closing direction, that is, towards the valve seat 46, by a helical spring 53. The connection unit 35 in the bottom portion 9 is arranged in a recess 54 at the bottom of the plunger recess 36 and comprises a valve seat 55 and a valve cone 56 with a guide pin 57 running in the guide 58, and a lift pin 60. The valve cone is urged in the closing direction, that is, towards the valve seat 55, by a spring 62. At the bottom of the plunger recess 36 there is a seal 61 which seals between the bottom of the recess and the end surface of the plunger 37.

During charging, the space 44 is under pressure and the plunger 37 is kept in released position, that is, is moved to left so that the end surface 64 of the flange 38 makes contact with the end surface 65 of the sleeve 41. The valve cones 47 and 56 are then held pressed against their valve seats. After inserting the bottom portion 9, the space 44 is emptied and the spring bundle 43 presses the plunger into the recess 36. The support plate 21 can now be lowered and the inserting manipulator be removed. The portion 9 is now supported by the plungers 37. The lift pins 52 and 60 will then make contact with each other, so that the valve cones 47 and 56 are raised from their respective valve seats, thus obtaining a free connection through the connection units. Coolant is supplied through one connection unit and is removed through another.

By this invention a coolant connection is obtained which may be disconnected with a very insignificant loss of pressure medium. The risks of the coolant coming into contact with hot charges are substantially eliminated. The combination of a plunger and a coolant connection guarantees that the inner bottom portion is put into connection with the source of the coolant the moment it is mounted and connected with the annular bottom portion. The risk of the bottom portion not being cooled is thus eliminated.

Figure 3:
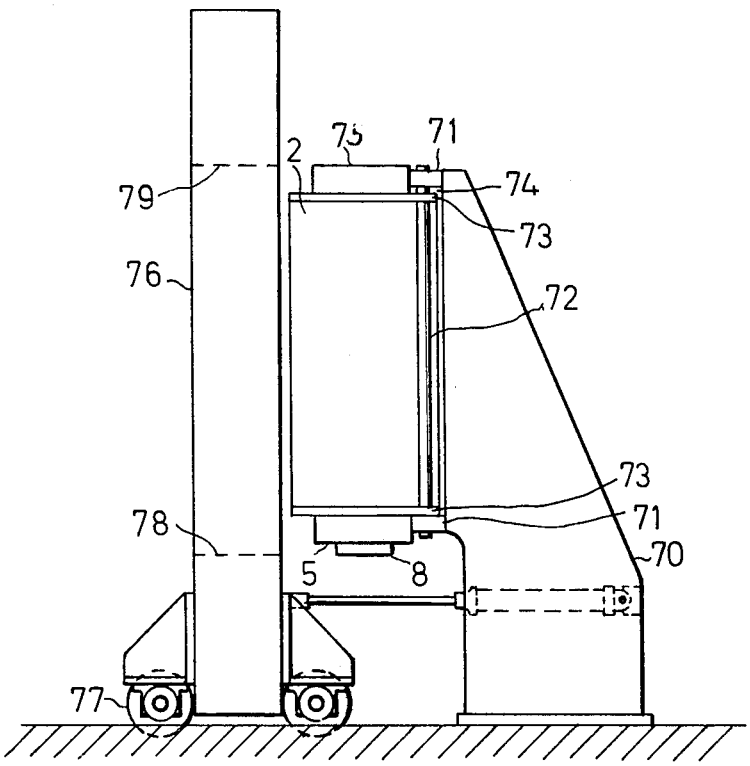
FIG. 3 shows a side view of a press having a high pressure chamber in which the invention is incorporated.

In FIG. 3 is shown a pressure chamber 2 carried by a stand 70. This stand is provided with two lugs 71 in which a rod 72 is inserted. The cylinder 2 is provided with two lugs 73 having bearing surfaces accommodating the rod 72. The distance between the outer surfaces of the lugs 73 is less than the distance between the inner surfaces between the lugs 71. This means that the cylinder is axially displaceable by a distance which is just as long as the difference in distance between said surfaces. The cylinder normally rests on the lower lug 71, a gap 74 thus being formed between the upper lugs 71 and 73, which makes it possible to lift the cylinder 2 a distance equal to the size of the gap 74. The cylinder is closed by the lower end closure 8, movable on the ring 5, and by an upper end closure 75 projecting somewhat into the cylinder. The press contains a displaceable press stand 76 which is supported by wheels 77. The press stand 76 is displaced between the position shown in FIG. 3 to a position surrounding the cylinder 2. When pressurizing the container the surfaces 78 and 79 take up the forces acting upon the end closures 75 and 8, thus preventing them from being pressed out from the cylinder 2. When moving the press stand 76 the end closures 75 and 8 are pushed to their innermost positions so that there is a clearance between the end closures 75 and 8 and the surfaces 79 and 78, respectively.

I claim:

1. A pressure furnace for treating products at high temperature and high pressure, comprising a high pressure chamber including a vertical high pressure cylinder with end closures projecting into the cylinder, a press stand with a window aperture which is somewhat larger than the length of the high pressure chamber when the end closures are fully inserted, which press stand encloses the high pressure chamber during the pressing operation and takes up the axial forces which a pressure medium in the pressure chamber exerts on the end closures, and a support member for the pressure chamber, which support member holds the pressure chamber in such a position that gaps are formed between the press stand and the end closures of the chamber when the end closures are moved into their innermost positions in the cylinder, in which the lower end closure comprises a bottom portion provided with cooling channels, which bottom portion carries material to be pressed during charging and pressing, at least one stationary and one movable connection unit for connecting the bottom portion to a coolant source, of which the movable unit is radially displaceable between a connected position in contact with the stationary connection unit and a released position, and a valve member in at least one of the connection units, which, in released position, is held pressed against a valve seat and means carried by one of the units to raise the valve from its seat in response to relative movement between the units to the connecting position.

2. Pressure furnace according to claim 1, in which the lower end closure comprises an annular first portion, permanently attached in the high pressure cylinder, and a second inner portion arranged inside said first portion to support the pressed material, the movable connection unit being carried by the first annular postion.

3. Pressure furnace according claim 1, in which the connection unit simultaneously constitutes a plunger means to support the inner bottom portion when it has been placed in the first annular portion.

4. Pressure furnace according to claim 3, in which the displaceable connection unit comprises an annular piston which is operated at least in one direction by means of a hydraulic pressure medium.

5. Pressure furnace according to claim 4, in which the displaceable connection unit is urged by a spring in a direction towards the connection position.

* * * * *